United States Patent [19]

Kebanli

[11] Patent Number: 4,490,285

[45] Date of Patent: Dec. 25, 1984

[54] HEAVY-DUTY LIQUID DETERGENT COMPOSITION

[75] Inventor: Ertuğrul S. Kebanli, Cincinnati, Ohio

[73] Assignee: The Procter & Gamble Company, Cincinnati, Ohio

[21] Appl. No.: 519,611

[22] Filed: Aug. 2, 1983

[51] Int. Cl.[3] ..... C11D 1/83; C11D 7/42

[52] U.S. Cl. ..... 252/551; 252/174.11; 252/532; 252/DIG. 14

[58] Field of Search ..... 252/532, 551, DIG. 14, 252/174.11

[56] References Cited

U.S. PATENT DOCUMENTS

| | | | |
|---|---|---|---|
| 3,985,687 | 10/1976 | Inamorato et al. | 252/551 |
| 4,024,078 | 5/1977 | Gilbert et al. | 252/551 |
| 4,028,280 | 6/1977 | Murata et al. | 252/526 |
| 4,092,272 | 5/1978 | Nishimura et al. | 252/545 |
| 4,111,855 | 9/1978 | Barrat et al. | 252/545 |
| 4,166,048 | 8/1979 | Nishimura et al. | 252/546 |
| 4,224,195 | 9/1980 | Kawasaki et al. | 252/546 |
| 4,287,082 | 9/1981 | Tolfo et al. | 252/174.12 |
| 4,305,837 | 12/1981 | Kaminsky et al. | 252/174.12 |
| 4,318,818 | 3/1982 | Letton et al. | 252/174.12 |

FOREIGN PATENT DOCUMENTS

| | | |
|---|---|---|
| EP 8141 | 2/1980 | European Pat. Off. . |
| 22007 | 2/1977 | Japan . |
| 36107 | 3/1977 | Japan . |
| 1397245 | 6/1975 | United Kingdom . |

*Primary Examiner*—Prince E. Willis

*Attorney, Agent, or Firm*—Donald E. Hasse; Robert B. Aylor; Thomas H. O'Flaherty

[57] ABSTRACT

Heavy-duty liquid detergent compositions containing ethoxylated alcohol nonionic surfactant and specific anionic surfactant, which is a sulfated approximately monoethoxylated fatty alcohol.

9 Claims, No Drawings

HEAVY-DUTY LIQUID DETERGENT COMPOSITION

TECHNICAL FIELD

The present invention relates to concentrated heavy-duty liquid detergent compositions containing ethoxylated alcohol nonionic surfactant and a narrowly defined, sulfated ethoxylated alcohol anionic surfactant. More particularly, the invention concerns the use of sulfated approximately monoethoxylated alcohol anionic surfactants in selected detergent compositions to provide improved detergency performance on an equal weight basis or comparable performance on an equal molar but lower weight basis, when compared with higher ethoxylated alcohol sulfate anionic surfactants.

BACKGROUND ART

U.S. Pat. No. 4,318,818, Letton et al., issued Mar. 9, 1982, discloses heavy-duty liquid detergents containing enzymes and an enzyme-stabilizing system comprising calcium ion and a low molecular weight carboxylic acid or salt, preferably a formate. The compositions can contain various surfactants, including the anionic and nonionic surfactants herein. Examples 1 and 13 disclose compositions containing $C_{12-13}$ alkylpolyethoxylate (6.5) and $C_{12-14}$ alkylpolyethoxylate(3) sulfate.

U.S. Pat. No. 4,024,078, Gilbert et al, issued May 17, 1977, discloses liquid dishwashing detergents containing ethoxylated decyl alcohol sulfates having a high monoethoxylate content. Ethoxylated alcohol nonionic surfactants can be included in the compositions as optional ingredients, but are not exemplified.

SUMMARY OF THE INVENTION

This invention relates to heavy-duty liquid detergent compositions comprising, by weight:

(1) from about 10% to 40%, preferably from about 15% to about 25%, of a nonionic surfactant produced by condensing from about 3 to about 10 moles of ethylene oxide with 1 mole of an alcohol, preferably a primary alcohol, having a straight or branched alkyl chain containing from about 8 to about 16 carbon atoms, preferably from about 10 to about 14 carbon atoms, said nonionic surfactant having an HLB (hydrophilic-lipophilic balance) of from about 8 to about 15, preferably from about 9 to about 12;

(2) from about 5% to about 20%, on an acid basis, of an anionic surfactant which is a sulfated condensation product of an alcohol having a straight or branched alkyl chain containing from about 10 to about 18 carbon atoms, preferably from about 12 to about 16 carbon atoms with from about 0.8 to about 1.5 moles of ethylene oxide per mole of alcohol; the weight ratio of (1) to (2) being from about 2:1 to about 4:1, preferably from about 2.3:1 to about 2.8:1; and (3) from about 40% to about 85% of a solvent system comprising water or mixtures thereof with an alcohol containing from 1 to 6 carbon atoms or a polyol containing from 2 to 6 carbon atoms and from 2 to 6 hydroxy groups.

DETAILED DESCRIPTION OF THE INVENTION

Nonionic Surfactant

The instant compositions contain as an essential ingredient from about 10% to about 40%, preferably from about 15% to about 25%, by weight of a nonionic detergent surfactant derived by condensing from about 3 to about 10, preferably from about 5 to about 8, moles of ethylene oxide with 1 mole of an alcohol having a straight or branched alkyl chain containing from about 8 to about 16, preferably from about 10 to about 14, carbon atoms. It is important that the nonionic surfactant have an HLB (hydrophilic-lipophilic balance) of from about 8 to about 15, preferably from about 9 to about 12. The HLB of the ethoxylated nonionics herein can be experimentally determined in a known fashion or can be calculated in the manner set forth in Dekker "Emulsions, Theory and Practice", Reinhold 1965, pages 233 and 248. The HLB of the nonionic surfactants can be approximated by the simple expression $HLB=E/5$, wherein E is the weight percentage of ethylene oxide content in the molecule. The HLB will vary for a given alkyl chain length with the amount of ethylene oxide in the molecule.

Mixtures of the foregoing nonionic surfactants are also useful herein and are readily available from commercial alcohol mixtures. The degree of ethoxylation can also vary somewhat inasmuch as materials prepared by commercial processes are generally mixtures having a broad ethoxylate distribution. A particularly preferred nonionic surfactant is the condensation product of a mixture of $C_{12-13}$ fatty alcohol with approximatey 6.5 moles of ethylene oxide.

Anionic Surfactant

The anionic surfactant herein is a narrowly defined product prepared by first ethoxylating an alcohol, either straight or branched chain, having an alkyl group containing from about 10 to about 18 carbon atoms, preferably from about 12 to about 16 carbon atoms, with an average of from about 0.8 to about 1.5, preferably about 1, mole of ethylene oxide per mole of alcohol, by a conventional alkaline-catalyzed ethoxylation reaction; sulfating the resulting product; and then neutralizing with an appropriate base. The products obtained have a substantial amount of alkyl sulfate and a mixture of ethoxylate chain lengths. The anionic surfactant is used as a water soluble or dispersible salt, preferably a sodium, potassium, ammonium, monethanol ammonium, diethanol ammonium, triethanol ammonium, or magnesium salt, or mixtures thereof.

A particularly preferred anionic surfactant is the sodium salt of the sulfated reaction product of a mixture of fatty alcohols containing from about 12 to about 14 carbon atoms with approximately 1 mole of ethylene oxide.

The weight ratio of the nonionic surfactant to the anionic surfactant (on an acid basis) should be from about 2:1 to about 4:1, preferably from about 2.3:1 to about 2.8:1. The total amount of nonionic and anionic (on the acid basis) surfactant is from about 15% to about 50%, preferably from about 25% to about 35%.

Solvent System

The compositions of the present invention also contain from about 40% to about 85%, preferably from about 55% to about 70%, by weight of a solvent system comprising water, or mixtures thereof with an alcohol containing from 1 to 6 carbon atoms or a polyol containing from 2 to 6 carbon atoms and from 2 to 6 hydroxy groups. The compositions can contain from 0% to about 30%, preferably from about 3% to about 15%, more preferably from about 5% to about 10%, of the alcohol or polyol.

Examples of suitable alcohols are methanol, ethanol, propanol, isopropanol, and n-hexanol. Monohydric alcohols are preferred for solubilizing the surfactant but polyols containing from 2 to 6 carbon atoms and from 2 to 6 hydroxy groups can be used. Examples of such polyols include propylene glycol, ethylene glycol and glycerine. Ethanol is a particular preferred alcohol.

Optional Ingredients

In addition to the essential ingredients, the compositions herein preferably contain other ingredients known for use in detergent compositions. Optional ingredients include other surfactants, builders, neutralizing agents, buffering agents, phase regulants, hydrotropes, enzymes, enzyme stabilizing agents, polyacids, suds regulants, opacifiers, antioxidants, bactericides, dyes, perfumes, and brighteners, all of which are described in U.S. Pat. No. 4,285,841, Barrat et al., issued Aug. 25, 1981, incorporated herein by reference. Such optional ingredients, generally represent less than about 15%, preferably from about 2% to about 10%, by weight of the detergent composition.

Enzymes are highly preferred optional ingredients and are incorporated in an amount of from about 0.025% to about 2%, preferably from about 0.05% to about 1.5%. Preferred proteolytic enzymes should provide a proteolytic activity of at least about 5 Anson units (about 1,000,000 Delft units) per liter, perferably from about 15 to about 70 Anson units per liter, most preferably from about 20 to about 40 Anson units per liter. A proteolytic activity of from about 0.01 to about 0.05 Anson units per gram of product is desirable. Other enzymes, including amylolytic enzymes, are also desirably included in the present compositions.

The enzymes herein are preferably characterized by an isoelectric point of from about 8.5 to about 10, more preferably from about 9 to about 9.5.

Suitable proteolytic enzymes include the many species known to be adapted for use in detergent compositions. Commercial enzyme preparations such as "Alcalase" sold by Novo Industries, and "Maxatase" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

Suitable amylases include "Rapidase" sold by Gist-Brocades and "Termamyl" sold by Novo Industries.

A more complete disclosure of suitable enzymes can be found in U.S. Pat. No. 4,101,457, Place et al, issued July 18, 1978, incorporated herein by reference.

When enzymes are incorporated in the detergent compositions of this invention, they are desirably stabilized by using a mixture of a short chain carboxylic acid salt and calcium ion.

The short chain carboxylic acid salt is preferably water-soluble, and most preferably is a formate, e.g., sodium formate. The short chain carboxylic acid salt is used at a level from about 0.25% to about 10%, preferably from about 0.3% to about 3%, more preferably from about 0.5% to about 1.5%. At the higher product pH's (8.5–10), only formates are suitable.

Any water-soluble calcium salt can be used as a source of calcium ion, including calcium acetate, calcium formate and calcium propionate. The composition should contain from about 0.1 to about 30 millimoles of calcium ion per liter, preferably from about 0.5 to about 15 millimoles of calcium ion per liter. When materials are present which complex calcium ion, it is necessary to use high levels of calcium ion so that there is always some minimum level available for the enzyme. Preferably, the compositions are substantially free of materials such as detergent builders that tie up calcium ion to permit sufficient enzyme-available calcium to be present. However, excellent enzyme stability is achieved with very low levels of calcium ion when the formates are used, especially at a low pH (less than about 8.5).

The pH of the compositions herein is from about 6.5 to about 10, preferably from about 7 to about 8.5. Suitable pH buffers include mono-, di- and triethanolamines. When the product pH is from about 8.5 to about 10, triethanolamine is the preferred buffer. When soap or fatty acid is present, the preferred pH is from about 7 to about 7.5.

Detergent hydrotropes suitable for use herein include salts of alkylarylsulfonates having up to 3 carbon atoms in the alkyl group, e.g., sodium, potassium, ammonium and ethanolamine salts of xylene-, toluene-, ethyl- benzene-, cumene-, and isopropyl-benzene sulfonic acis. Such hydrotropes are frequently used in an amount from about 1% to about 10%.

Preferred compositions also contain from about 0.01% to about 1% of polyacid or salt thereof. Suitable polyacids include citric, cyclohexane-1,1-dicarboxylic, cyclopropane-1,1-dicarboxylic, dimethylamlic, glutaric, o-hydroxybenzoic, m-hydroxybenthylamlic, p-hydroxybenzoic, itaconic, methylsuccinic, or nitrilotriacetic acid. Preferred polyacids for use herein are citric acid, ethylenediamine tetramethylenephosphonic acid, diethylene triamine pentamethylenephosphonic acid, and diethylenetriamine pentaacetic acid, or the salts thereof. These polyacids/salts are preferably used in an amount from about 0.1% to about 0.8%.

The following examples illustrate the compositions of the present invention.

All parts, percentages and ratios used herein are by weight unless otherwise specified.

EXAMPLE I

| Components | Wt. % A | B | C |
|---|---|---|---|
| Sodium $C_{12-14}$ alkylpolyethoxylate (3) sulfate (on an acid basis) | — (11.2) | 11.6 | — |
| Sodium $C_{12-14}$ alkylethoxylate (1) sulfate (on an acid basis) | 8.6 (8.1) | — | 9.4 (8.8) |
| $C_{12-13}$ alkylpolyethoxylate (6.5) | 21.5 | 21.5 | 21.5 |
| Ethanol | 6.9 | 10 | 5.7 |
| Sodium formate | 1.5 | 1 | 1.6 |
| Water and minor ingredients | | Balance | |
| pH | 7.5 | 7.5 | 7.5 |

The above compositions were prepared by mixing the components in the following order: ethanol, alkylpolyethoxylate sulfate paste, formate, water, alkylpolyethoxylate, and minor ingredients including enzyme.

The compositions were compared and found to provide comparable cleaning and sudsing performance, despite Compositions A and C of the present invention having substantially less of the ethoxylate sulfate surfactant on a weight basis than Composition B, a commercially available detergent.

What is claimed is:

1. A heavy-duty liquid detergent composition comprising, by weight:

(1) from about 10% to about 40% of a nonionic surfactant produced by condensing from about 3 to about 10 moles of ethylene oxide with 1 mole of an alcohol having a straight or branched alkyl chain containing from about 8 to about 16 carbon atoms, said nonionic surfactant having an HLB of from about 8 to about 15;

(2) from about 5% to about 20%, of an acid basis, of an anionic surfactant which is a sulfated condensation product of an alcohol having a straight or branched alkyl chain containing from about 10 to about 18 carbon atoms with from about 0.8 to about 1.5 moles of ethylene oxide per mole of alcohol; the weight ratio of (1) to (2) being from about 2:1 to about 4:1; and (3) from about 40% to about 85% of a solvent system comprising water, or mixtures thereof with an alcohol containing from 1 to 6 carbon atoms or a polyol containing from 2 to 6 carbon atoms and from 2 to 6 hydroxy groups.

2. The composition of claim 1 comprising from about 15% to about 25% of the nonionic surfactant (1), and wherein the weight ratio of (1) to (2) is from about 2.3:1 to about 2.8:1.

3. The composition of claim 2 wherein the anionic surfactant is a sulfated condensation product of an alcohol having an alkyl chain containing from about 12 to about 16 carbon atoms with about 1 mole of ethylene oxide per mole of alcohol.

4. The composition of claim 3 wherein the nonionic surfactant is a condensation product of a primary alcohol having an alkyl chain containing from about 10 to about 14 carbon atoms with from about 5 to about 8 moles of ethylene oxide per mole of alcohol, said nonionic surfactant having an HLB of from about 9 to about 12.

5. The composition of claim 4 wherein the solvent system represents from about 55% to about 70% by weight of the composition and is a mixture of water and ethanol, with the ethanol representing about 5% to about 10% by weight of the composition.

6. The composition of claim 1 further comprising from about 0.025% to about 2% of an enzyme.

7. The composition of claim 6 wherein the enzyme comprises a proteolytic enzyme having a proteolytic activity of at least about 5 Anson units per liter.

8. The composition of claim 7 further comprising from about 0.25% to about 10% of a water soluble formate and from about 0.1 to about 30 millimoles of calcium ion per liter.

9. The composition of claim 5 further comprising from about 0.025% to about 2% of an enzyme, from about 0.5% to about 1.5% of a water soluble formate, and from about 0.5 to about 15 millimoles of calcium ion per liter.

* * * * *